US005854543A

United States Patent [19]

Satoh et al.

[11] Patent Number: 5,854,543

[45] Date of Patent: Dec. 29, 1998

[54] INVERTER CIRCUIT FOR LIGHTING A COLD CATHODE TUBE BY THE USE OF A PIEZOELECTRIC TRANSFORMER

[75] Inventors: Hiroyuki Satoh; Yoshihiro Ino; Hutoshi Shiotani, all of Miyagi, Japan

[73] Assignee: Tokin Corporation, Miyagi, Japan

[21] Appl. No.: 773,969

[22] Filed: Dec. 26, 1996

[30] Foreign Application Priority Data

Dec. 26, 1995 [JP] Japan ..... 7-338623

[51] Int. Cl.[6] ..... H05B 41/00; H05B 37/02

[52] U.S. Cl. ..... 315/307; 315/291; 315/277; 315/279; 310/316

[58] Field of Search ..... 310/316, 318, 310/317; 315/308, 307, 291, 277, 279, DIG. 4

[56] References Cited

U.S. PATENT DOCUMENTS

| | | | |
|---|---|---|---|
| 3,743,868 | 7/1973 | Kawada | 331/116 R X |
| 5,548,189 | 8/1996 | Williams | 315/224 |

FOREIGN PATENT DOCUMENTS

| | | |
|---|---|---|
| 374 617 | 6/1990 | European Pat. Off. . |
| 665 600 | 8/1995 | European Pat. Off. . |
| 706 306 | 4/1996 | European Pat. Off. . |
| 08149850 | 6/1996 | Japan . |
| 8-149850 | 7/1996 | Japan . |

OTHER PUBLICATIONS

EPO Search Report dated Mar. 12, 1997.

*Primary Examiner*—Arnold Kinkead

*Attorney, Agent, or Firm*—Hopgood, Calimafde, Kalil & Judlowe

[57] ABSTRACT

In an inverter circuit including a piezoelectric transformer (17) for supplying a voltage signal to a cold-cathode tube (50), a driver (12) for driving the piezoelectric transformer, a voltage-controlled oscillator (11) for producing an oscillation pulse voltage signal having an oscillation frequency controlled by a control voltage, a phase difference detection circuit (15) for detecting as a detected phase difference a phase difference between input and output voltage signals of the piezoelectric transformer, and a control circuit (16) for producing the control voltage so that the detected phase difference is coincident with a predetermined value, a current detection circuit (21) detects as a detected current value a current which flows through the cold-cathode tube. Supplied with the oscillation pulse voltage signal and the detected current value, a power control section (22) controls an electric power of the oscillation pulse voltage signal so that the detected current value has a preselected value. The power control section produces a power-controlled pulse voltage signal and supplies the power-controlled pulse voltage signal to the driver.

4 Claims, 7 Drawing Sheets

INVERTER CIRCUIT FOR LIGHTING A COLD CATHODE TUBE BY THE USE OF A PIEZOELECTRIC TRANSFORMER

BACKGROUND OF THE INVENTION

This invention relates to an inverter circuit supplied with a DC supply voltage for lighting a cold-cathode tube and, in particular, to an inverter circuit for lighting a cold-cathode tube by the use of a piezoelectric transformer.

A conventional inverter circuit of the type is disclosed in Japanese Unexamined Patent Publication (A) No. 149850/1996 and will later be described in detail in the present specification. The Inverter circuit is,for example, is used in lighting a backlight of a notebook-type personal computer. In this case, a DC supply voltage supplied to the inverter circuit Is susceptible to fluctuation in level because the DC supply voltage is supplied from either an adapter or a battery. In the inverter circuit, such fluctuation of the DC supply voltage brings about variation of a cold-cathode tube current which flows through a cold-cathode tube. This inevitably results in variation of the luminance of the cold-cathode tube.

For this purpose, the variation of the luminance of the cold-cathode tube resulting from the fluctuation of the DC supply voltage can be suppressed by using a method which will also later be described. According to the method, the piezoelectric transformer is, however, decreased in efficiency.

SUMMARY OF THE INVENTION

It is therefore an object of this invention to provide an inverter circuit for lighting a cold-cathode tube by the use of a piezoelectric transformer, which circuit is capable of suppressing variation In luminance of the cold-cathode tube resulting from fluctuation of a DC supply voltage without decreasing the efficiency of the piezoelectric transtormer.

Other objects of this invention will become clear as the description proceeds.

An inverter circuit to which this invention Is applicable is supplied with a DC supply voltage for lighting a cold-cathode tube. The inverter circuit includes; a piezoelectric transformer responsive to a transtormer input voltage signal for producing a transformer output voltage signal and for supplying the transformer output voltage signal to the cold-cathode tube to thereby light the cold-cathode tube; a transformer driver responsive to a driver input pulse voltage signal for producing a transformer drive voltage signal for use in driving the piezoelectric transformer, the transformer driver delivering the transformer drive voltage signal to the piezoelectric transformer as the transformer input voltage signal; a voltage-controlled oscillator supplied with a control voltage for producing an oscillation pulse voltage signal having an oscillation frequency controlled by the control voltage; pulse voltage supply means for supplying the oscillation pulse voltage signal to the transformer driver as the driver input pulse voltage signal, a phase difference detection circuit for detecting as a detected phase difference a phase difference between the transformer input voltage signal and the transformer output voltage signal; and a control circuit for producing the control voltage so that the detected phase difference is coincident with a predetermined value.

According to this invention, the inverter circuit comprises a cold-cathode tube current detection circuit for detecting as a detected current value a cold-cathode tube current which flows through the cold-cathode tube. The pulse voltage supply means comprises a power control section supplied with the oscillation pulse voltage signal and the detected current value for controlling an electric power of the oscillation pulse voltage signal so that the detected current value has a preselected value.

The power control section produces a power-controlled pulse voltage signal as the driver input pulse voltage signal.

Preferably, the power control section comprises: an integrating circuit for integrating the oscillation pulse voltage signal to produce an integrated voltage signal; and a pulse width control circuit responsive to the integrated voltage signal and to the detected current value for producing as the power-controlled pulse voltage signal a sequence of pulses, each having a pulse amplitude equal to the DC supply voltage and a pulse width controlled so that the detected current value has the preselected value.

The power control section may comprise means for varying the preselected value in a predetermined current range. Alternatively, the pulse width control circuit may comprise means for varying the preselected the predetermined current range.

DESCRIPTION OF THE PREFERRED EMBODIMENT

Figure 1:
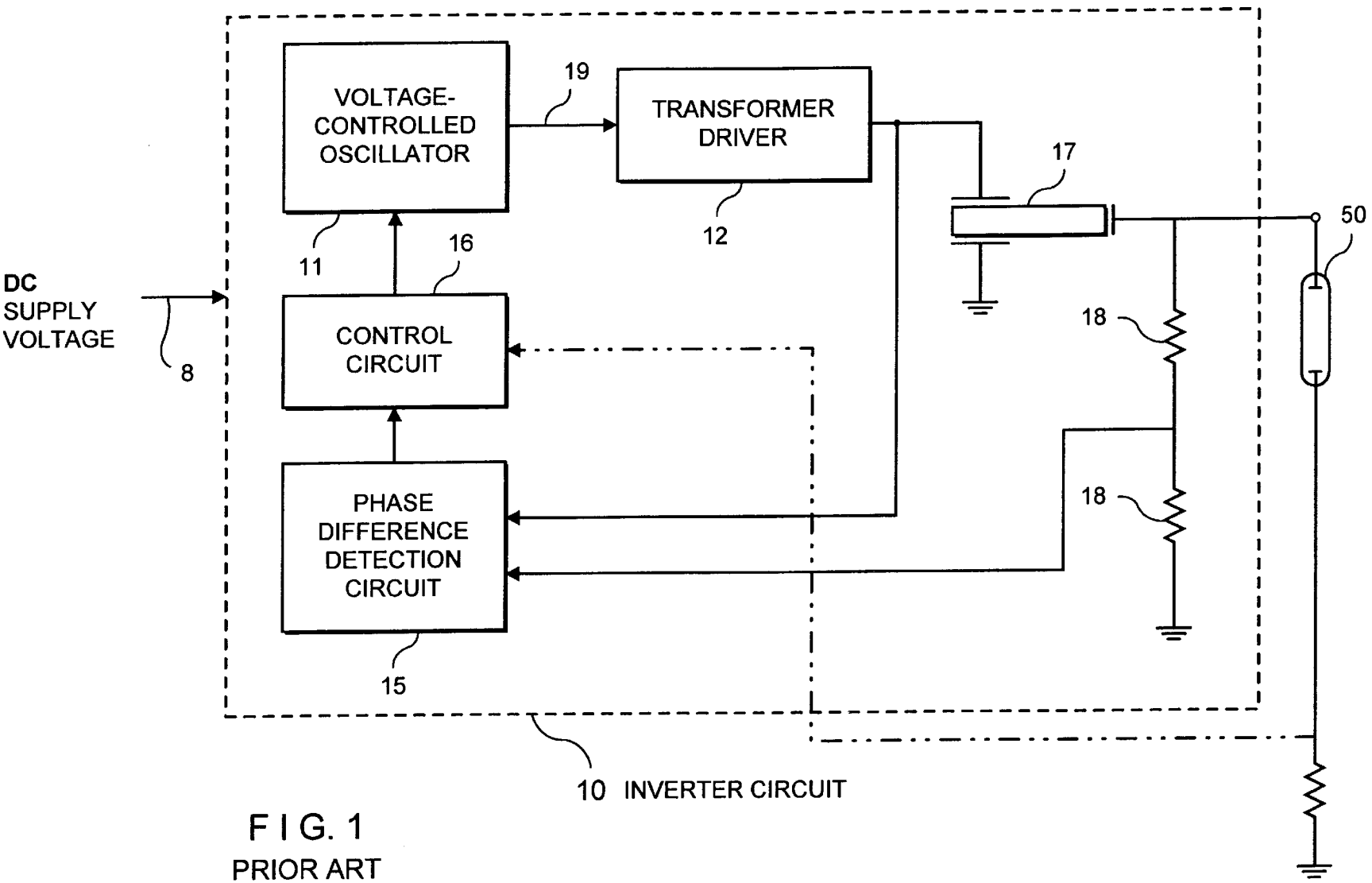
FIG. 1 PRIOR ART
FIG. 1 is a block diagram of a conventional inverter circuit.

Referring to FIG. 1, a conventional inverter circuit 10 will first be described for a better understanding of this invention. The inverter circuit 10 is disclosed in the above-mentioned Japanese Unexamined Patent Publication No. 149850/1996. The inverter circuit 10 is supplied with a DC supply voltage 8 for lighting a cold-cathode tube 50.

The inverter circuit 10 comprises a piezoelectric transformer 17 having first and second input terminals and an output terminal. The second input terminal is connected to ground and the output terminal is connected to the cold-cathode tube 50. The first input terminal is supplied with a transformer input voltage signal. Responsive to the transformer input voltage signal, the piezoelectric transformer 17 produces a transformer output voltage signal. The piezoelectric transformer 17 supplies the transformer output voltage signal to the cold-cathode tube 50 to thereby light the cold-cathode tube 50.

Responsive to a driver input pulse voltage signal, a transformer driver 12 produces a transformer drive voltage signal for use in driving the piezoelectric transformer 17 The transformer driver 12 delivers the transformer drive voltage signal to the piezoelectric transformer 11 as the transformer input voltage signal.

Supplied with a control voltage, a voltage-controlled oscillator 11 produces an oscillation pulse voltage signal having an oscillation frequency controlled by the control voltage. A pulse voltage supply line 19 supplies the oscillation pulse voltage signal to the transformer driver 12 as the driver input pulse voltage signal A phase difference detection circuit 15 detects as a detected phase difference a phase difference between the transformer input voltage signal and the transformer output voltage signal. A control circuit 16 produces the control voltage so that the detected phase difference is coincident with a predetermined value (which is equal to 90° in the manner which will later be described).

The cold-cathode tube 50 has a characteristic which will presently be described. Specifically, after the DC supply voltage 8 is supplied to the inverter circuit 10, substantially no electric current flows through the cold-cathode tube 50 until the cold-cathode tube 50 starts a discharge operation. When the discharge operation is started and the cold-cathode Lube 50 is lit, an electric current of the order between 5 mA and 10 mA flows through the cold-cathode tube 50 such that a voltage between both ends of the cold-cathode tube so is lowered. Thus, upon lighting the cold-cathode tube 50, it is required to produce a high voltage as a lighting voltage before the cold-cathode tube 50 is lit and to lower the lighting voltage once it is lit.

Figure 2A:
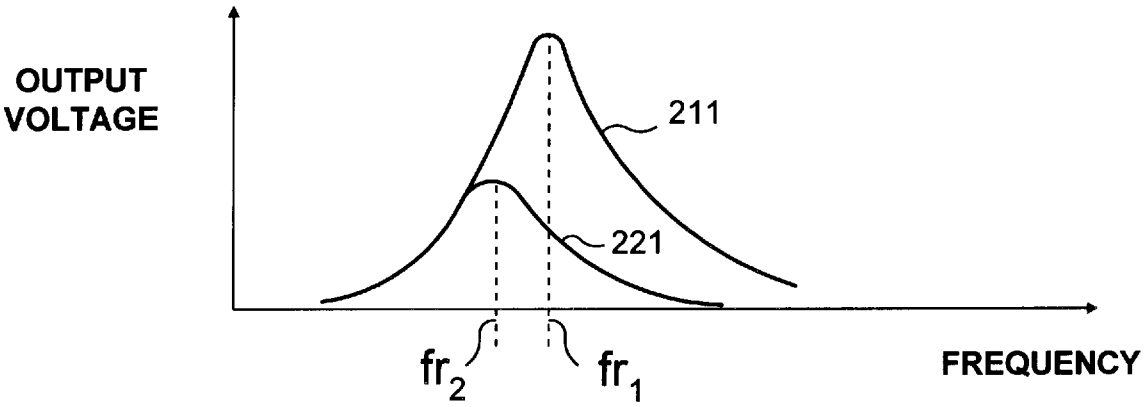
FIGS. 2A and 2B are views for use in describing operation of the conventional inverter circuit and of an inverter circuit of this invention.

In the meanwhile, the piezoelectric transformer 17 has a load characteristic (a frequency characteristic of an output voltage of the piezoelectric transformer 17) which will presently be described. As illustrated in FIG. 2A, when a load is small, a high voltage output Is obtained at a resonant frequency fr1 as depicted by a curve 211 in the figure. When the load is increased, the resonant frequency is lowered to fr2 as depicted by a curve 221 and the maximum output is reduced. Thus, the piezoelectric transformer 17 is suitable for use in lighting the cold-cathode tube 50.

Figure 2B:
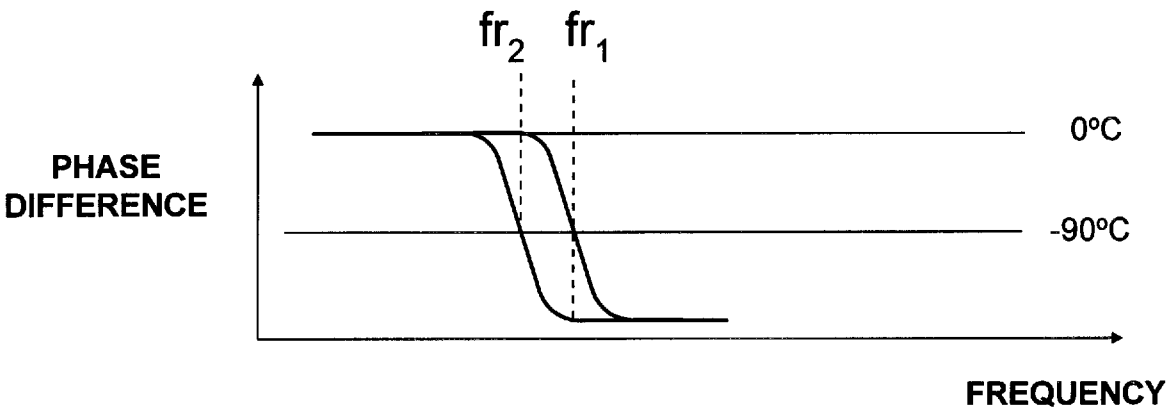

In FIGS. 1, 2A, and 2B, it is assumed that the voltage-controlled oscillator 11 produces the oscillation signal having an oscillation frequency fr1 In this event, the transformer drive voltage signal is supplied from the transformer driver 12 to the piezoelectric transformer 17 as the transformer input voltage signal. The piezoelectric transformer 17 thereby produces the transformer output voltage signal of a high voltage. At this time, the phase difference detection circuit 15 is already supplied with a waveform advancing in phase by 90° (advancement in phase by 90° being represented as "−90°" ) from that of the transformer input voltage signal supplied to the piezoelectric transformer 17 (namely, a waveform of the transformer output voltage signal detected by an output detection voltage-dividing resistor 18). in this event, the phase difference detection circuit 15 detects a phase difference of 90°. Accordingly, the control circuit 16 keeps the oscillation frequency of the voltage-controlled oscillator 11 unchanged.

Next, after the cold-cathode tube 50 is lit, the load is increased and a resonance point of the piezoelectric transformer 17 is shifted to fr2. At this time, the phase difference detection circuit 15 is supplied with a waveform of the transformer output voltage signal further advancing in phase by more than 90° from that of the transformer input voltage signal. Therefore, the phase difference detection circuit 15 detects a value greater than 90° as the detected phase difference. In response to the detected phase difference, the control circuit 16 produces the control voltage to lower the oscillation frequency of the voltage-controlled oscillator 11 so that the phase difference becomes equal to 90° . Thus, the oscillation frequency of the voltage-controlled oscillator 11 is shifted to fr2.

When the above-mentioned inverter circuit 10 is used in lighting, for example, a backlight of a notebook-type personal computer, the DC supply voltage 8 applied to the inverter circuit 10 is susceptible to fluctuation in level because it is supplied via an adapter or a battery. As described in the preamble of the present specification, such fluctuation of the DC supply voltage 8 brings about variation of a cold cathode tube current flowing through the cold-cathode tube 50. This inevitably results in variation of the luminance of the cold-cathode tube 50. Specifically, when the DC supply voltage 8 becomes high, the cold-cathode tube current Slowing through the cold-cathode tube 50 is increased so that the luminance of the cold-cathode tube 50 becomes too great. In other words, the cold-cathode tube 50 becomes too bright.

Figure 3:
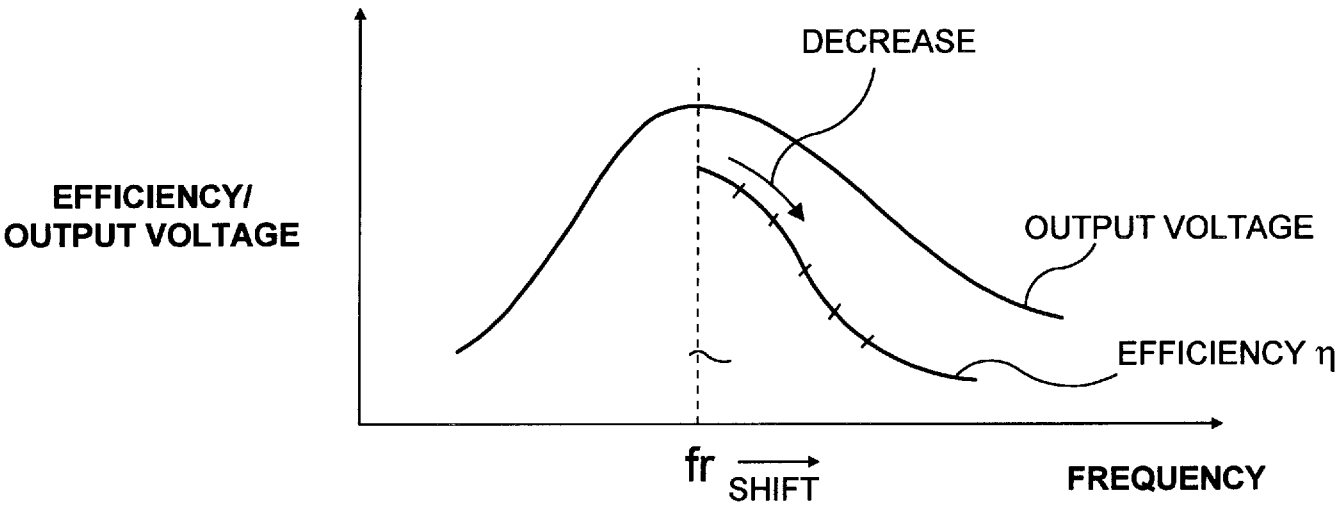
FIG. 3 PRIOR ART
FIG. 3 is a view for use in describing operation of the inverter circuit in FIG. 1.

In view of the above, as depicted at a virtual line in FIG. 1, the cold-cathode tube current may be fed back to the control circuit 16 to shift the oscillation frequency fr from the resonant frequency of the piezoelectric transformer 17 In response to the variation of the cold-cathode tube current in the manner shown in FIG. 3 (which shows a frequency versus output voltage characteristic of the piezoelectric transformer 17 and a frequency versus efficiency characteristic of the piezoelectric transformer 17). Thus, the voltage (the output voltage of the piezoelectric transformer 17) applied to the cold-cathode tube 50 is controlled to keep the cold-cathode tube current constant. In this method, an efficiency $\eta$ of the piezoelectric transformer 17 is, however, decreased by shifting the oscillation frequency from the resonant frequency as shown in FIG. 3.

Figure 4:
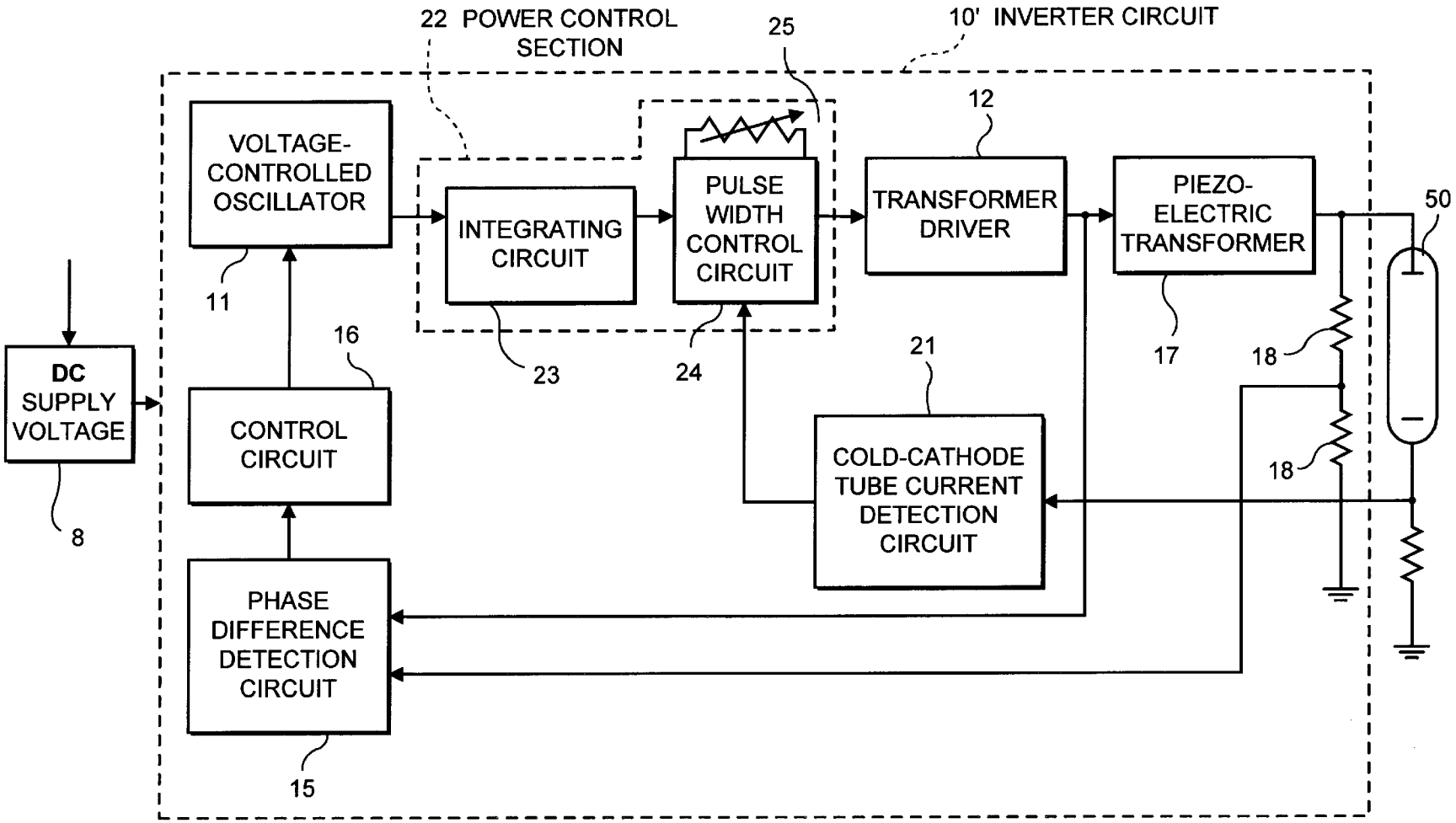
FIG. 4 is block diagram of an inverter circuit according to an embodiment of this invention.

Referring to FIG. 4, an inverter circuit 10' according to an embodiment of this invention comprises similar parts designated by like reference numerals. The inverter circuit 10' further comprises a cold-cathode tube current detection circuit 21 for detecting as a detected current value a cold-cathode tube current which flows through the cold-cathode tube so instead of the pulse voltage supply line 19 (FIG. 1), the inverter circuit 10' comprises a power control section 22. Supplied with the oscillation pulse voltage signal of the voltage-controlled oscillator 11 and with the detected current value, the power control section 22 controls an electric power of the oscillation pulse voltage signal so that the detected current value has a preselected value and produces a power controlled pulse voltage signal as the driver input pulse voltage signal of the transformer driver 12. The transformer driver 12 is typically a variable-power amplifier circuit.

More specifically, the power control section 22 comprises an integrating circuit 23 and a pulse width control circuit 24.

Figure 5:
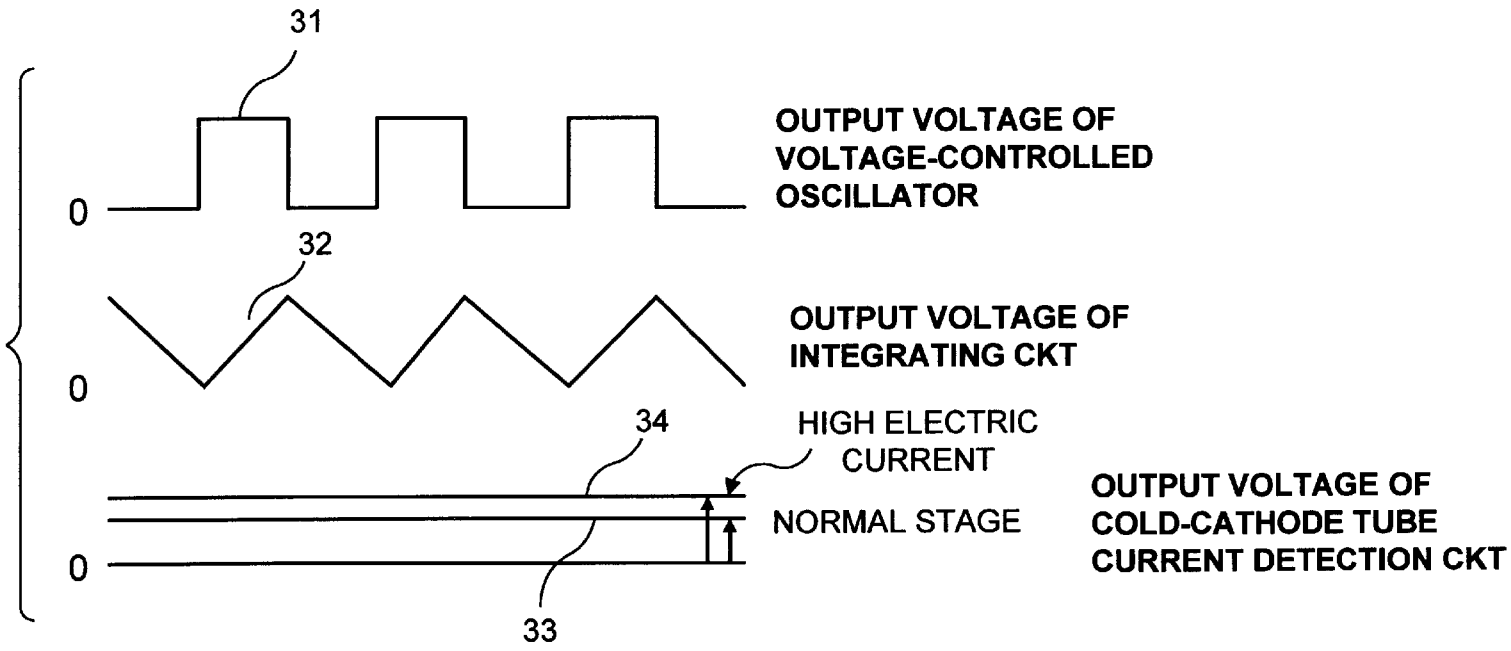
FIG. 5 is a view for use in describing operation of the inventor circuit illustrated in FIG. 4.

Referring to FIG. 5 in addition to FIG. 4, the integrating circuit 23 is, for example, an RC integrating circuit and integrates the oscillation pulse voltage signal (31 in FIG. 5) of the voltage-controlled oscillator 11 to produce an integrated voltage signal (32 in FIG. 5 ).

After the cold-cathode tube 50 is lit, the cold-cathode tube current detection circuit 21 detects as the detected current value a low current value depicted at 33 in FIG. 5 during a normal state in which the DC supply voltage 8 has a prescribed value. When the DC supply voltage 8 becomes higher than the prescribed value, the cold-cathode tube detection circuit 21 detects as the detected current value a high current value depicted at 34 in FIG. 5.

Figure 6:
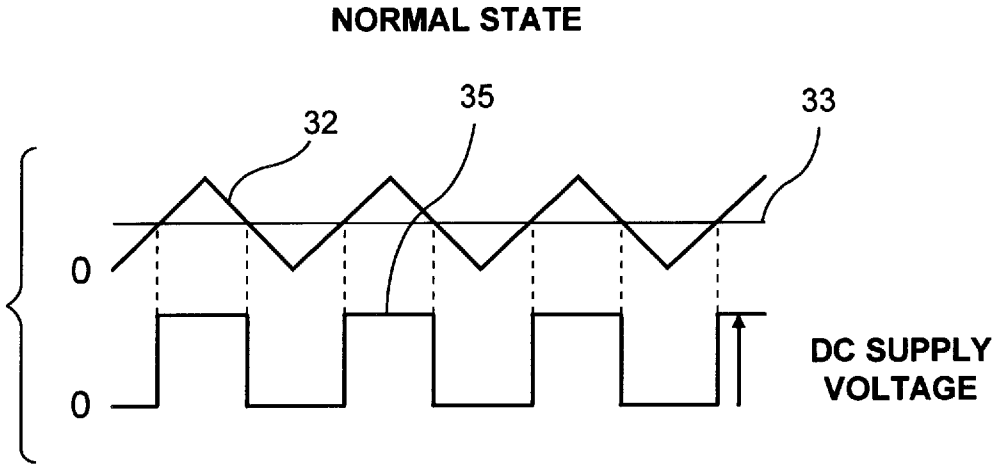
FIG. 6 is another view for use in describing operation of the inverter circuit illustrated in FIG. 4.

Referring to FIGS. 4 and 6, the pulse width control circuit 24 compares the integrated voltage signal 32 and the detected current value (low current value) 33 during the normal state in which the DC supply voltage 8 has the prescribed value. The pulse width control circuit 24 thereby produces as the power-controlled pulse voltage signal a sequence 35 of pulses, each of which has a pulse amplitude equal to the DC supply voltage 8 and a wide pulse width determined by the detected current value (low current value) 33.

Figure 7:
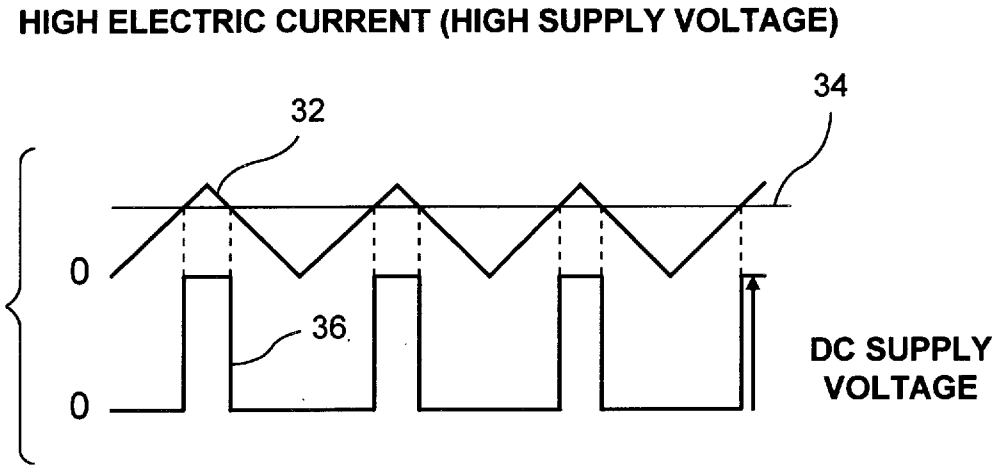
FIG. 7 is still another view for use in describing operation of the inverter circuit illustrated in FIG. 4.

Referring to FIGS. 4 and 7, the pulse width control circuit 24 compares, when the DC supply voltage 8 becomes higher than the prescribed value, the integrated voltage signal 32 and the detected current value (high current value) 34 and produces as the power-controlled pulse voltage signal another sequence 36 of pulses, each of which has another pulse amplitude equal to the DC supply voltage 8 and a narrow pulse width determined by the detected current value (high current value) 34.

Figure 8:
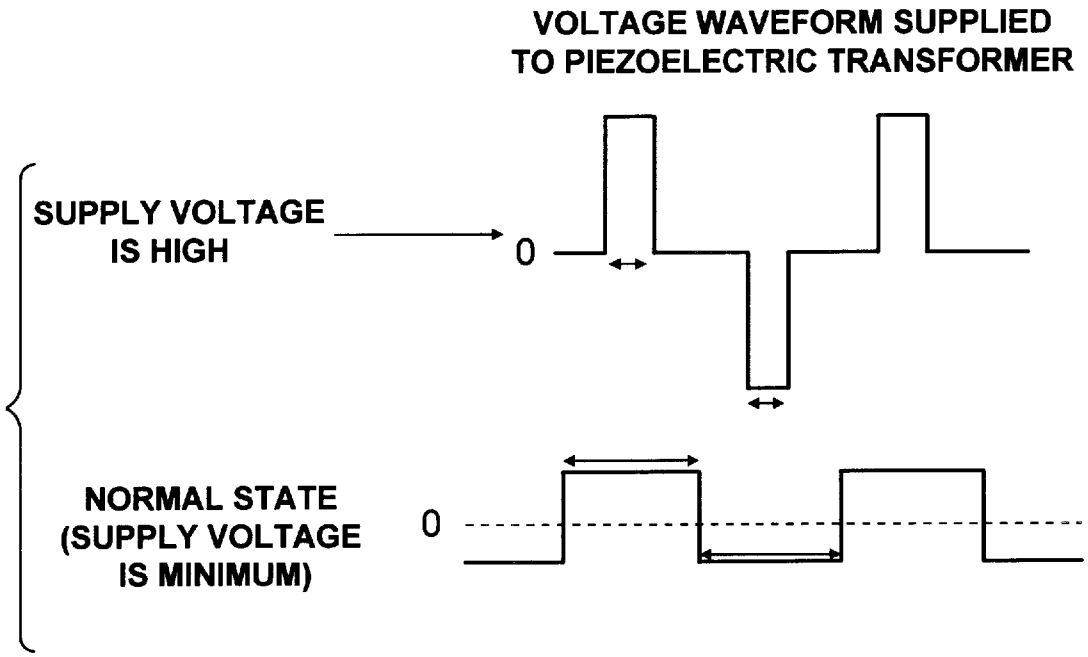
FIG. 8 is yet another view for use in describing operation of the inverter circuit illustrated in FIG. 4.

Referring to FIGS. 4 and 8, during the normal state in which the DC supply voltage 8 has the prescribed value, the transformer driver (variable power amplifier circuit) 12 produces, in response to the sequence 35 (FIG. 6) of pulses, the transformer drive signal having a wide pulse width and a high electric power as depicted along a lower row in FIG. 8. On the other hand, when the DC supply voltage 8 becomes higher than the prescribed value, the transformer driver (variable power amplifier circuit) 12 produces, in response to the sequence 36 (FIG. 7) of pulses, the transformer drive signal having a narrow pulse width and a low electric power as depicted along an upper low in FIG. 8. As a result, an output of the piezoelectric transformer 17 becomes small so that the cold-cathode tube current of an appropriate current value flows through the cold cathode tube so to keep the luminance of the cold-cathode tube 50 constant.

Thus, in response to the integrated voltage signal and to the detected current value, the pulse width control circuit 24 produces, as the power-controlled pulse voltage signal, a sequence of pulses, each having a pulse amplitude equal to the DC supply voltage 8 and a pulse width controlled so that the detected current value has the preselected value (the value of the cold-cathode tube current during the normal state in which the DC supply voltage 8 has the prescribed value, as shown at 33 in FIG. 5). Specifically, the pulse width control circuit 24 produces the sequence of pulses, each having a greater pulse amplitude and a narrower pulse width as the DC supply voltage 8 becomes higher.

When the DC supply voltage 8 is lowered, an input power of the piezoelectric transformer 17 is controlled in the similar manner. In this embodiment, the preselected value of the cold-cathode tube current of the cold-cathode tube 50 is determined in correspondence to a minimum point in fluctuation of the supply voltage possibly caused during the normal state. Accordingly, the input power is controlled when the DC supply voltage 8 is increased.

In FIG. 4, the pulse width control circuit 24 comprises an external variable resistor 25 capable of varying the preselected value (the value of cold-cathode tube current during the normal state in which the DC supply voltage 8 has the prescribed value, as shown at 33 in FIG. 5) in a predetermined current range. By controlling a resistance value of the external variable resistor 25, it is possible to vary the value of the cold-cathode tube current during the normal state in which the DC supply voltage 8 has the prescribed value and to thereby control the luminance of the cold-cathode tube.

As described above, according to this invention, the inverter circuit for lighting a cold-cathode tube by the use of the piezoelectric transformer is capable of suppressing fluctuation in luminance of the cold-cathode tube resulting from the variation of the DC supply voltage without decreasing the efficiency of the piezoelectric transformer.

What is claimed is:

1. An inverter circuit supplied with a DC supply voltage for lighting a cold-cathode tube, said inverter circuit including, a piezoelectric transformer responsive to a transformer input voltage signal for producing a transformer output voltage signal and for supplying said transformer output voltage signal to said cold-cathode tube to thereby light said cold-cathode tube; a transformer driver responsive to a driver input pulse voltage signal for producing a transformer drive voltage signal for use in driving said piezoelectric transformer, said transformer driver delivering said transformer drive voltage signal to said piezoelectric transformer as said transformer input voltage signal, a voltage-controlled oscillator supplied with a control voltage for producing an oscillation pulse voltage signal having an oscillation frequency controlled by said control voltage; pulse voltage supply means for supplying said oscillation pulse voltage signal to said transformer driver as said driver input pulse voltage signal, a phase difference detection circuit for detecting as a detected phase difference a phase difference between said transformer input voltage signal and said transformer output voltage signal; and a control circuit for producing said control voltage so that said detected phase difference is coincident with a predetermined value; wherein:

said inverter circuit comprises a cold-cathode tube current detection circuit for detecting as a detected current value a cold-cathode tube current which flows through said cold-cathode tube;

said pulse voltage supply means comprising a power control section supplied with said oscillation pulse voltage signal and said detected current value for controlling an electric power of said oscillation pulse voltage signal so that said detected current value has a preselected value, said power control section producing a power-controlled pulse voltage signal as said driver input pulse voltage signal.

2. An inverter circuit as claimed in claim 1, wherein said power-control section comprises means for varying said preselected value in a predetermined current range.

3. An inverter circuit as claimed in claim 1, wherein said power control section comprises: an integrating circuit for integrating said oscillation pulse voltage signal to produce an integrated voltage signal; and a pulse width control circuit responsive to said integrated voltage signal and to said detected current value for producing as said power-controlled pulse voltage signal a sequence of pulses, each having a pulse amplitude equal to said DC supply voltage and a pulse width controlled so that said detected current value has said preselected value.

4. An inverter circuit as claimed in claim 3, wherein said pulse width control circuit comprises means for varying said preselected value in a predetermined current range.

* * * * *